United States Patent [19]

Warsop

[11] 4,306,430

[45] Dec. 22, 1981

[54] NOVEL STITCH BONDED FABRICS

[76] Inventor: David H. Warsop, 15 Meins Croft, Blackburn, Lancashire, England

[21] Appl. No.: 103,855

[22] Filed: Dec. 14, 1979

[30] Foreign Application Priority Data

Dec. 14, 1978 [GB] United Kingdom ..... 48615/78

[51] Int. Cl.[3] ..... D04B 23/08; D04B 23/10

[52] U.S. Cl. ..... 66/193; 66/190; 66/192

[58] Field of Search ..... 66/170, 171, 190, 192, 66/195, 193

[56] References Cited

U.S. PATENT DOCUMENTS 3,664,154 5/1972 Kochta et al. ..... 66/190
3,718,011 2/1973 Peschl et al. ..... 66/192
3,782,137 1/1974 Hughes ..... 66/192
3,992,902 11/1976 Webb et al. ..... 66/192

*Primary Examiner*—Ronald Feldbaum
*Attorney, Agent, or Firm*—Oblon, Fisher, Spivak, McClelland & Maier

[57] ABSTRACT

Novel stitch bonded fleece fabrics are made on two guide bar machines with the front bar knitting pillar stitch and the back bar with incomplete e.g. half set threading, traversing adjacent wales of the front bar and forming stitches in only one of said adjacent wales and having fewer stitches than courses. Stitches that have both front and back thread loops are made significantly smaller and tighter than stitches with front bar thread loops only, and this gives rise to a compact bunching of the fleece fibres giving a marked woven weft effect.

8 Claims, 7 Drawing Figures

NOVEL STITCH BONDED FABRICS

This invention relates to novel stitch bonded fleece fabrics.

Stitch bonded fleece fabric is made by stitching a fibre fleece, usually a cross-folded card web, with rows (or wales) of warp thread stitches. Most such fabric is made on single guide bar machines such as the Arachne and Maliwatt machines, though a proportion is made on two guide bar machines.

The basic fabric is uninteresting as regards its appearance. Scope exists, on single bar machines, only to bring about a rib effect by missing out occasional warp threads. A common form of two bar fabric is made with pillar stitches on the front bar and tricot stitches on the back bar.

There have been proposals for adding lengthwise and transverse ribs (to result in a check effect) to two bar fabrics by missed thread patterning on the back bar, with an occasional traverse of the back bar thread structure over three or even more wales of the front bar pillar stitch structure.

None of these measures disguises the fact that the fabric is based on a fibre fleece. The fabric is suitable for a number of end uses, for example as printed curtains, bedspreads, tickings and so on, but it is usually regarded as a relatively coarse fabric of inferior quality when compared with conventional woven or knitted fabrics, of commercial interest only because, containing mostly fibres and very little yarn, it is a relatively inexpensive.

The present invention, however, provides a stitch bonded fabric that much more closely resembles fabric made of warp and weft yarn, rather than warp yarn with a fibre filling.

The invention comprises a stitch bonded fleece fabric comprising front and back bar structures of warp threads, characterised in that the front bar structure comprises pillar stitch chains and the back bar structure has incomplete threading and extends over adjacent wales of the front bar structure, with stitches in only one of said adjacent wales.

The back bar structure may comprise stitches and laid-in sections of thread, or stitches, laid-in sections and floats of thread, and may comprise one stitch every three courses, or one stitch every other course, or two stitches every three courses, for example.

The effect of this is that those stitches that comprise both front bar and back bar thread loops are significantly smaller and tighter than the stitches that have front bar thread loops but no back bar thread loops, provided that the back bar thread tension is suitably adjusted. The fleece fibres are pulled into compact, well-defined bundles by the tight loops, and into looser, less compact bundles by the longer loops. The bundles, especially the compact bundles, closely resemble weft threads in a weave. This tension also has the effect of pulling the adjacent wales of pillar stitches closer together—and it may even be arranged that the tension is high enough to pull the adjacent wales of pillar stitches into contact, or such close proximity as to resemble a Leno weave.

Different back bar pattern notations give different spacings and ordering of spacings between the weftway bundles, giving the effect of different kinds of weave, and the overall result, depending on the precise configuration of the back bar stitches, will resemble a weft-insertion fabric or even a Leno weave fabric.

Examples of stitch bonded fleece fabrics according to the invention will now be described with reference to the accompanying drawings, in which:

FIG. 1 is a point diagram for the front bar thread structure common to all the examples, FIG. 2 is a point diagram for the back bar thread structure of a first example, FIG. 3 is a point diagram of the back bar structure for a second example, FIG. 4 is a point diagram of the back bar structure for a third example, FIG. 5 is a diagrammatic illustration of the appearance of the fabric of the first example, FIG. 6 is a like illustration for the second example, and FIG. 7 is a like illustration for the third example.

FIG. 1 illustrates the standard pillar stitch that is the conventional basis of single bar stitch bonded fabrics. However, whereas, in such conventional fabrics, and even in conventional two bar fabrics, the stitches manifest themselves in the fabric (both before and after finishing) as equally spaced parallel rows (wales) of stitches, according to the present invention, the front bar wales are pulled together into pairs (or, it might be, threes) to make a distinctively different kind of fabric.

The back bar thread structures illustrated in FIGS. 2, 3 and 4 have this in common, that they extend over adjacent wales of the front bar stitches, and that they form stitches in one only of the adjacent wales. As illustrated, the back bar threads extend over only two adjacent wales of front bar pillar stitches; but of course it is possible also to contemplate their extending over three or even more adjacent wales.

Example I, illustrated by FIGS. 2 and 5, has a back bar structure comprising stitches 21, laid in sections 22 of thread, and thread floats 23. There are fewer stitches than courses, with a stitch 21 only every third course. In conventional warp knitting notation, the back bar structure is 0-1, 2-2, 2-2. The back bar threading is "1 miss 1", that is to say there is a back bar thread only every other wale—"half-set" threading. Back bar stitches occur one in every three courses in this Example.

Figure 5:
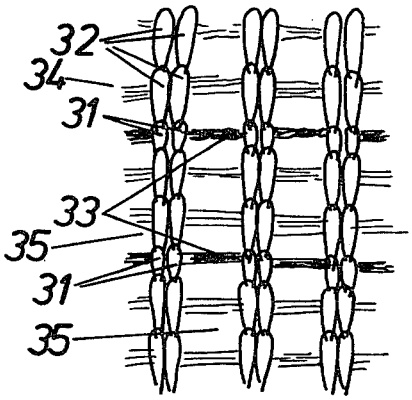
Figure 6:
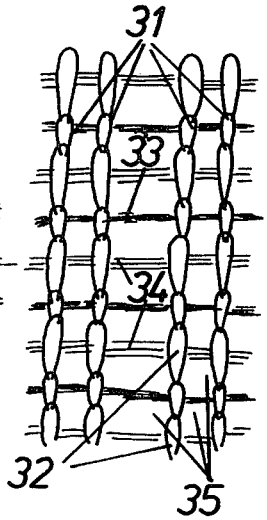
Figure 7:
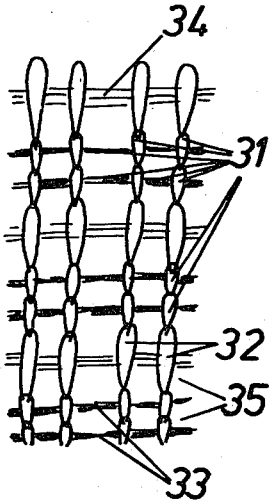

The tension in the back bar thread, in each case, is controlled so that those stitches that have back bar loops and front bar loops—namely stitches 31 in FIGS. 5, 6 and 7—are smaller and tighter than the stitches (32 in the same three Figures) that have only front bar loops. The weft fibres are pulled into compact bundles 33 by these tight stitch loops 31, resembling weft threads in a woven fabric. The fibre bundles 34 that pass through only the longer, looser stitches 32 are not so compact, nevertheless they too have the appearance of weft threads in a weave because the formation of the more compact bundles 33 has left weft-wise extending open spaces 35.

Figure 1:
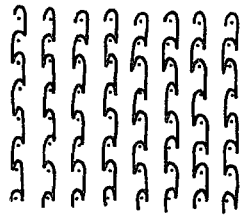
Figure 2:
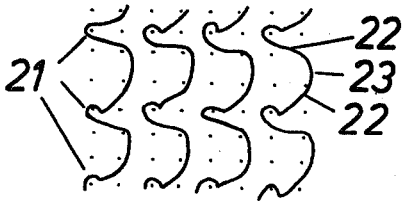
Figure 3:
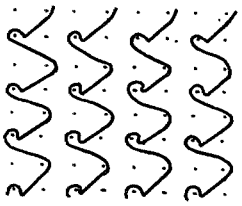
FIGS. 3 and 6 illustrate another fabric, Example II, for which the back bar threading is again "1 miss 1", and the back bar pattern notation is 0-1, 2-2. The back bar forms stitches every other course in this Example.
Figure 4:
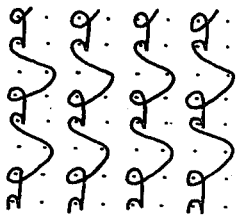
FIGS. 4 and 7 illustrate another fabric, Example III, for which the back bar again has half-set threading and its pattern notation this time is 0-1, 1-0, 2-2. This gives two back bar stitches—both of course in the same wale—every three courses.

The tension in the back bar thread might be arranged to be so high as to actually pull the adjacent front bar threads together into effectively a single wale. Such is illustrated in FIG. 5. However, the tension may not be so high, so that the adjacent front bar wales are merely pulled into more closely spaced pairs as shown in FIGS. 6 and 7. Tension is usually adjusted by first setting the run-in of the thread to a predetermined figure and then making minor adjustments to the let-off mechanism until the machine is knitting properly. Nominal run-in figures for the construction of FIGS. 2 and 5, in which the adjacent front bar wales are pulled into contact, are 97" (246 cm) for the front bar and 38" (97 cm) for the back bar. This means, of course, that 97" and 38" of thread are fed in to the front and back guide bars respectively, via a positive feed let-off motion of the beam, every rack or 480 courses.

The back bar run-in for Examples II and III would be adjusted to achieve the precise wale spacing required.

When it is said herein that the back bar stitches of each thread have been confined to a single wale, this is not to imply that they cannot—either in the front bar or the back bar or both—be moved into an adjacent wale for some special effect. A fabric might be produced, for example, with the back bar pattern notation of any of Examples I to III repeated over several cycles, then altered to a different notation—perhaps involving back bar loops in the or a wale that previously had no back bar loops. This different pattern notation might be continued for a few more cycles before reverting to the first, and so on.

The back bar threads might in this way, connect, alternately, a front bar wale with its right hand neighbour, then with its left hand neighbour. Other variations might also be made, for example, by using missed thread patterning on the front bar, and/or pulling three adjacent front bar wales together with one or two adjacent back bar threads.

Though the terms "front" and "back" bar have been used, it is to be understood that the invention can also be carried into effect on machines having more than two guide bars so that there will be three or more sets of warp threads.

What we claim is:

1. A stitch bonded fleece fabric comprising fibres bonded by front and back bar structures of warp threads wherein the front bar structure comprises pillar stitch chains and the back bar structure has part set threading and wherein said back bar structure extends over at least two adjacent wales of the front bar structure, with stitches in only one of said at least two adjacent wales.

2. A stitch bonded fleece fabric according to claim 1 wherein said back bar structure comprises stitches and laid-in sections of thread.

3. A stitch bonded fleece fabric according to claim 1 wherein said back bar structure comprises stitches and laid-in sections and floats of thread.

4. A stitch bonded fleece fabric according to claim 1 wherein said back bar structure comprises one stitch every three courses.

5. A stitch bonded fleece fabric according to claim 1 wherein said back bar structure comprises one stitch every other course.

6. A stitch bonded fleece fabric according to claim 1 wherein said back bar structure comprises two stitches every three courses.

7. A stitch bonded fleece fabric according to claim 1 wherein said back bar thread tension being such that stitches containing back bar thread loops as well as front bar thread loops are significantly tighter and smaller than stitches containing front bar thread loops but no back bar thread loops, so that the fleece fibres are pulled into more compact bundles by the tight loops giving rise to the appearance of weft threads.

8. A stitch bonded fleece fabric according to claim 1 wherein there is half set threading in said back bar.

* * * * *